US006418678B2

(12) United States Patent
Rotter

(10) Patent No.: US 6,418,678 B2
(45) Date of Patent: Jul. 16, 2002

(54) CONTOURED ROOF VENTILATION STRIP AND INSTALLATION SYSTEM

(76) Inventor: Martin J. Rotter, 115 Linsmore Ave., Glenside, PA (US) 19038

( * ) Notice: Subject to any disclaimer, the term of this patent is extended or adjusted under 35 U.S.C. 154(b) by 0 days.

(21) Appl. No.: 09/785,077

(22) Filed: Feb. 16, 2001

Related U.S. Application Data

(60) Provisional application No. 60/182,959, filed on Feb. 16, 2000.

(51) Int. Cl.[7] ..... F24F 7/02; E04D 13/17

(52) U.S. Cl. ..... 52/199; 52/302.1; 52/302.3; 454/365

(58) Field of Search ..... 52/198, 199, 57, 52/302.1, 302.3, DIG. 15; 454/365

(56) References Cited

U.S. PATENT DOCUMENTS 4,817,506 A * 4/1989 Cashman ..... 454/365
5,174,076 A * 12/1992 Schiedegger et al. ..... 52/199
5,352,154 A * 10/1994 Rotter et al. ..... 454/365
5,561,953 A * 10/1996 Rotter ..... 52/198
5,704,834 A * 1/1998 Sells ..... 454/365
6,077,159 A * 6/2000 Clayton ..... 52/199 X

FOREIGN PATENT DOCUMENTS

JP 5-171760 * 7/1993 ..... 52/302.1
JP 5-171763 * 7/1993 ..... 52/302.1

* cited by examiner

*Primary Examiner*—Laura A. Callo
(74) *Attorney, Agent, or Firm*—Volpe and Koenig, P.C.

(57) ABSTRACT

A contoured roof ventilation system having a strip with an air-permeable portion located adjacent to a ridge slot. Stand-off clips are provided which can be placed over the air-permeable strip at fastener locations which are located on flat portions of the roof panels. A sealing material may be placed beneath the air-permeable strip at such fastener locations to prevent the ingress of moisture beneath the panels.

7 Claims, 3 Drawing Sheets

CONTOURED ROOF VENTILATION STRIP AND INSTALLATION SYSTEM

CROSS-REFERENCE TO RELATED APPLICATIONS

This application claims the benefit of U.S. Provisional Application No. 60/182,959, filed Feb. 16, 2000.

BACKGROUND

It is known to ventilate the roof structure of a building utilizing a ridge vent. Such vents are created by an open slot running along the roof ridge, which causes ventilation out of the attic by convection air flow and by suction from wind blowing across the roof. A strip of air permeable material is installed over the ridge slot which prevents the ingress of moisture and debris, but allows air flow for ventilation. A ridge cap is then installed over the air permeable strip.

For roofs having contoured shapes, such as roofs having an outer surface formed by a roofing panel having a plurality of stiffening ribs and standing seams, it is known to use a ventilation strip having a surface which includes a plurality of recesses shaped to match the ribs or standing seams of the roof panel. The strip has an air-permeable portion in order to allow airflow. A ridge cap is then installed over the air-permeable strip. Such a system is described in U.S. Pat. No. 5,561,953, which was invented by the present inventor.

A problem has been identified, however, which arises during the installation of a ridge cap over the ventilation strips. The problem is based upon collapse of the air permeable strip in the fastener connection area. The problem does not exist for some styles of roofs in which fasteners can be installed on or near stiffening ribs. However, when fastening occurs away from a stiffening rib, through the ridge cap, the ventilation strip and into the decking, the ventilation strip can collapse during fastener installation, resulting in an uneven or damaged ridge cap. This can also create an entry point for moisture through the ridge cap and into the sheathing and internal roof support structure.

SUMMARY

The present invention is generally directed to a system for installing a ridge vent on a contoured roof in which a strip having an air-permeable portion is provided with a surface shape to match the projections of the contoured roof surface. Stand-off clips are provided which can be placed over the contoured, air-permeable strip at fastener locations which are located on flat portions of the roof panels.

In another aspect of the invention, a ridge vent system utilizing contoured air-permeable strips is provided. Stand-off clips are used at fastener locations on flat portions of the roofing panels. A sealing material is placed beneath the air-permeable strip at such fastener locations to prevent the ingress of moisture beneath the panels.

BRIEF DESCRIPTION OF THE DRAWING(S)

The foregoing Summary, as well as the following detailed description of the preferred embodiments of the invention will be better understood when read in conjunction with the appended drawings. For the purposes of illustrating the invention, there are shown in the drawings embodiments which are currently preferred. It should be understood, however, that the invention is not limited to the precise arrangements shown.

DETAILED DESCRIPTION OF THE PREFERRED EMBODIMENT(S)

Figure 1:
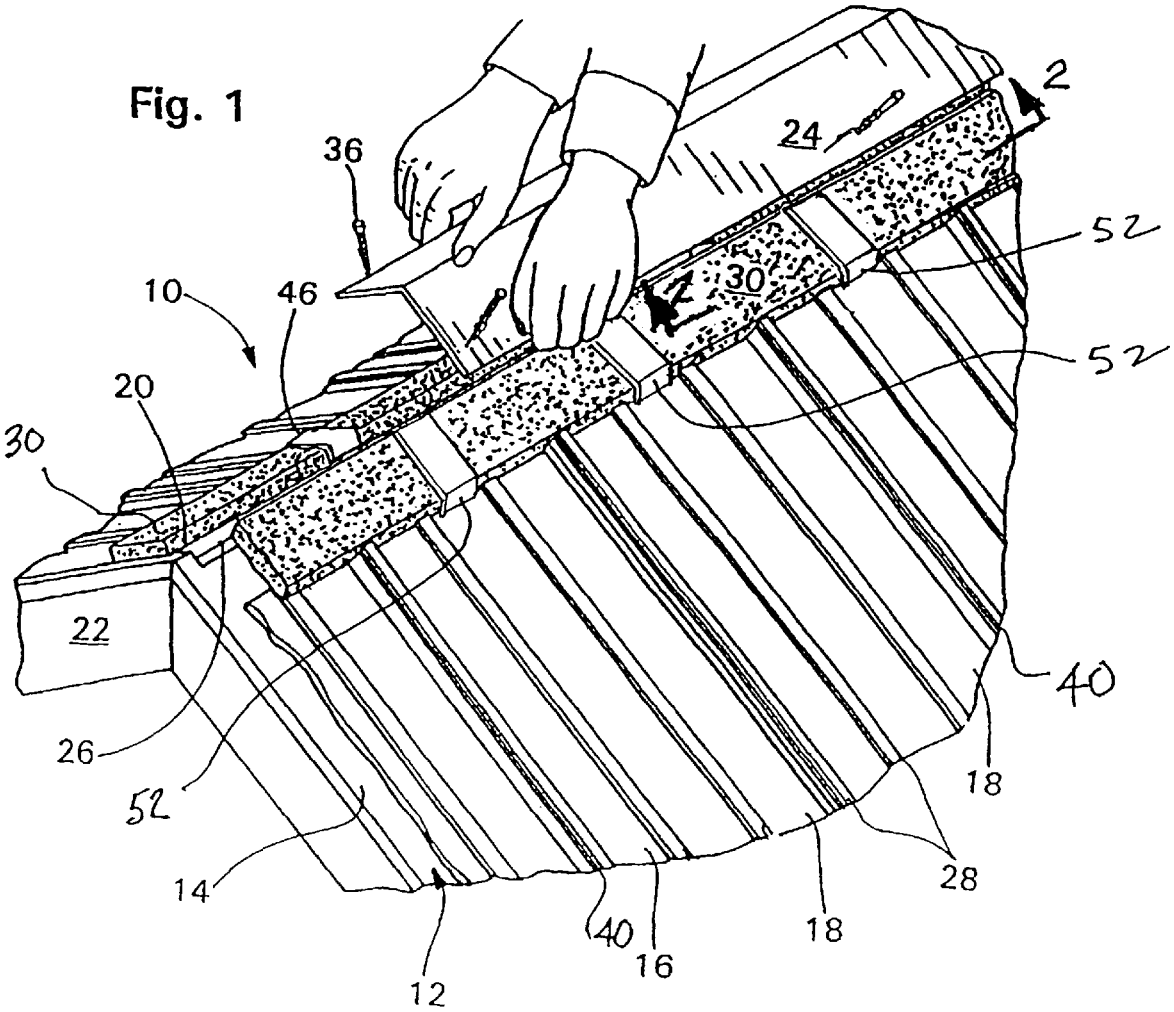
FIG. 1 is a perspective view of a portion of a roof ridge showing the installation of a roof ridge vent with a contoured air-permeable and resilient strip and stand-off clips in accordance with the present invention.

Certain terminology is used in the following description for convenience only and is not considered limiting. The words "right," "left," "lower," and "upper" designate directions in the drawings to which reference is made. This terminology includes the word specifically noted above, derivatives thereof and words of similar import. Additionally, the terms "a" and "one" are defined as including one or more of any reference item unless specifically noted.

Referring now to FIG. 1, a roof venting system 10 in accordance with the present invention is shown. The roof venting system 10 is described in relation to a sloped roof 12 having a decking 14 which is covered by an outer, weatherproof sheet 16, preferably formed by a plurality of contoured roof panels 18. The contoured roof panels 18 may be made of metal, fiber glass or any other suitable material and preferably include a plurality of stiffening ribs 28, with the ribs located at the edges of the contoured roof panels 18 being used to form a standing seam 40 between adjacent panels.

The upper row of decking 14 terminates approximately ¾ to 1 inch short of the crest of the roof ridge thereby defining a vent slot 26. The vent slot 26 may also be created during construction of the roof or may be retro-fitted using a circular saw to cut a slot in the decking 14.

Figure 2:
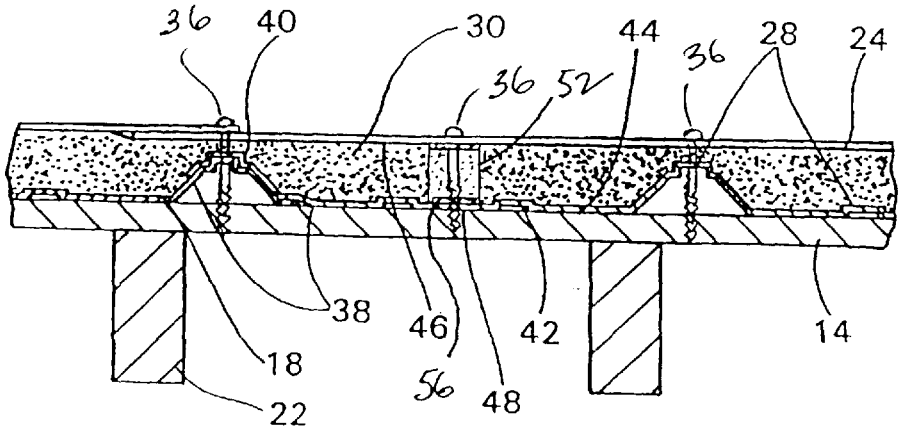
FIG. 2 is a cross-sectional view taken along line 2—2 in FIG. 1.
Figure 3:
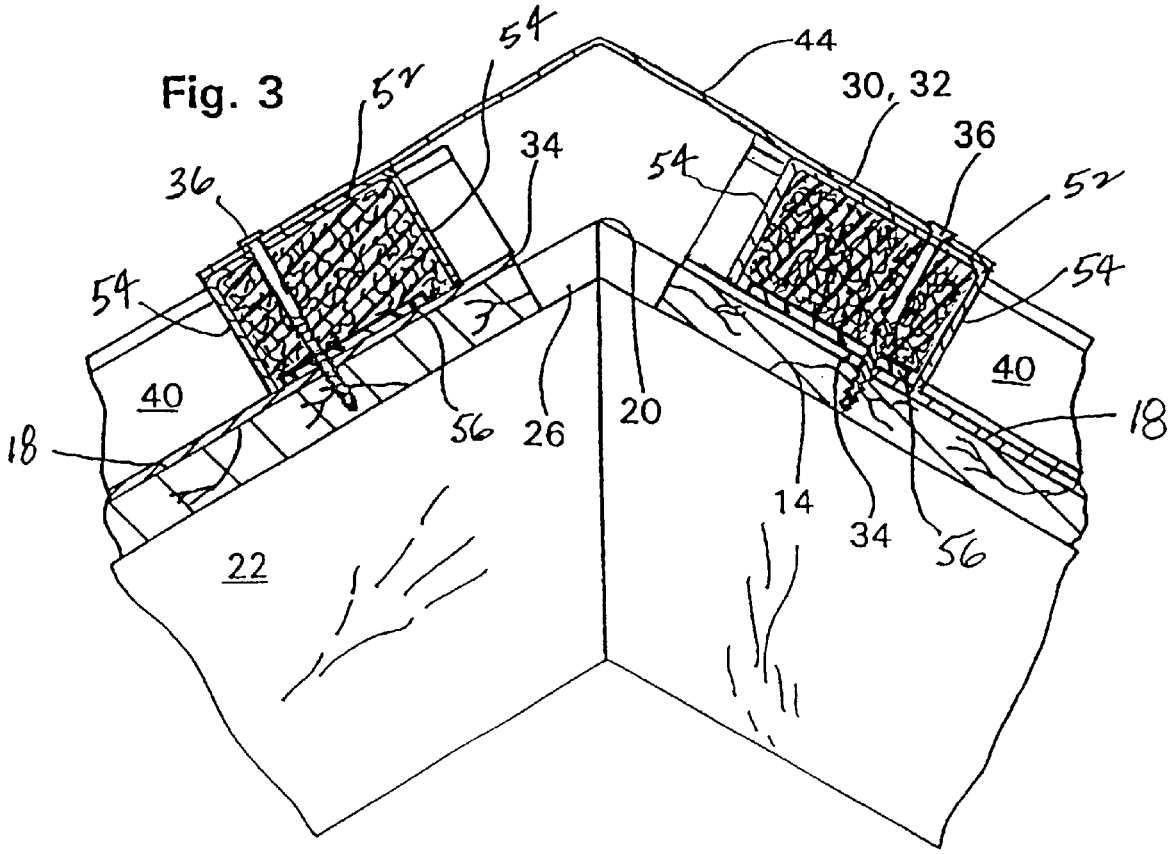
FIG. 3 is a cross-sectional view of a portion of the roof ridge shown in FIG. 1.
Figure 4:
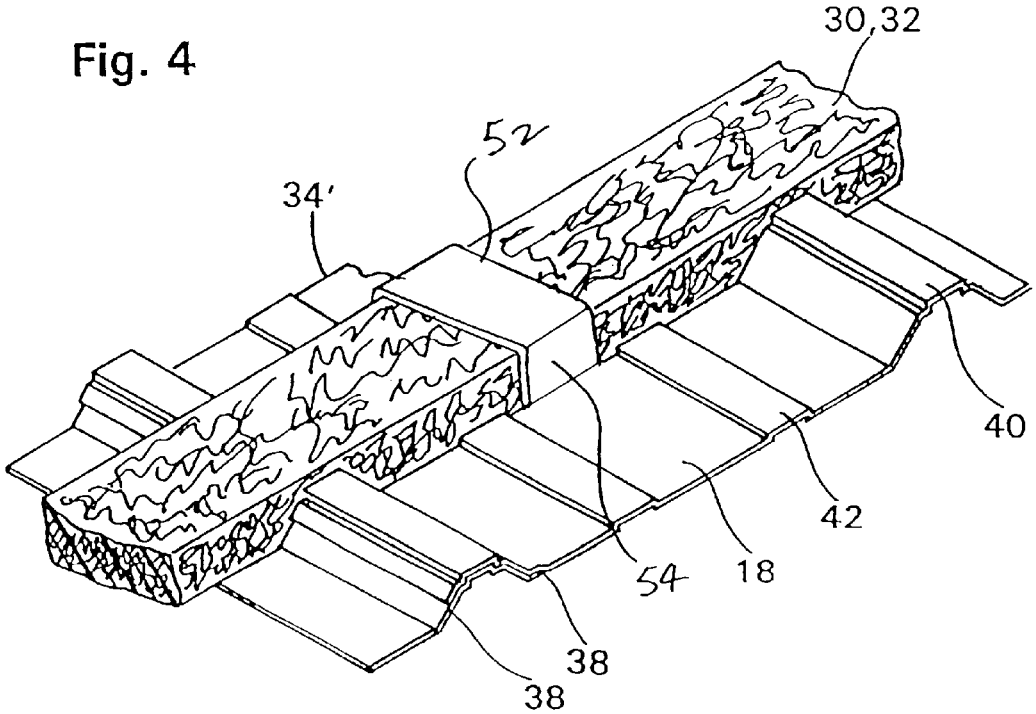
FIG. 4 is an enlarged perspective view of the air-permeable and resilient strip on the contoured roof panels with the stand-off clip positioned at a fastener location.

A strip 30, having an air permeable portion to allow ventilation, is preferably shaped on its lower surface 44 to match the contours of the roof panels 18. Preferably, one strip 30 is provided on either side of the vent slot 26. The ridge cap 24 is secured to the decking 14 over the strips 30 using a series of fasteners 36. As shown in FIG. 2, preferably the screw fasteners 36 are located at a standing seam 40 or at a stiffening rib 28, if possible. However, fasteners 36 are often required at locations along the contoured roof panels 18 at the spacing of 18–24 inches in order to ensure that the ridge cap 24 is securely held in position. At these intermediate, non-rib locations which fall in the flat field area of the contoured roof panels 18, it is possible to over-drive the screw fasteners 36, thereby bending the ridge cap 24 and over compressing the strip 30. In the preferred embodiment, the fasteners are screws, however, those skilled in the art will recognize other suitable fasteners, such as nails, can be used for the application.

As shown in detail in FIGS. 1 through 4, preferably a stand-off clip 52 is provided at these locations in order to prevent the screw fasteners 36 from over compressing the strip 30. Each stand-off clip 52 is preferably U shaped and is dimensioned to fit over the strip 30. The legs 54 of the stand-off clip 52 can be provided over-sized and trimmed to the proper size at installation. Alternatively, different size stand-off clips 52 can be provided to match the different thicknesses of the strip 30 which may be utilized. In the preferred embodiment, the stand-off clip 52 is made of galvanized metal. However, those skilled in the art will recognize from the present disclosure that other suitable materials could be used to make the stand-off clip 52. In a preferred embodiment, the stand-off clip 52 is approximately 3 in. wide and the legs are approximately 2 in. long such that they can be trimmed to size at installation.

Because the stand-off clips 52 or typically utilized in the flat field area of the contoured roof panels 18, preferably a sealing material 56 is provided at each stand-off clip location. The sealing material 56 may be a strip of butyl rubber, having an adhesive located on one side, or any other suitable sealing material compatible with the particular contoured roof panels 18. The sealing material 56 may be provided in pre-cut pieces or partially perforated strips which can be separated from a sheet of release paper, and placed in position under the strip 30 at each fastener location which does not correspond to a sufficiently large stiffening rib 20 to prevent over-driving of the fastener 36.

While the strip 30 must have at least a portion that is air-permeable to allow the passage of air to ventilate the roof, preferably the entire strip 30 is an air-permeable material 32. Although other air-permeable-materials could be used, the preferred air permeable material 32 is a strip of non-woven synthetic fiber matting, as described in the inventor's prior U.S. Pat. No. 5,167,579, which is incorporated herein by reference as if fully set forth.

Figure 5:
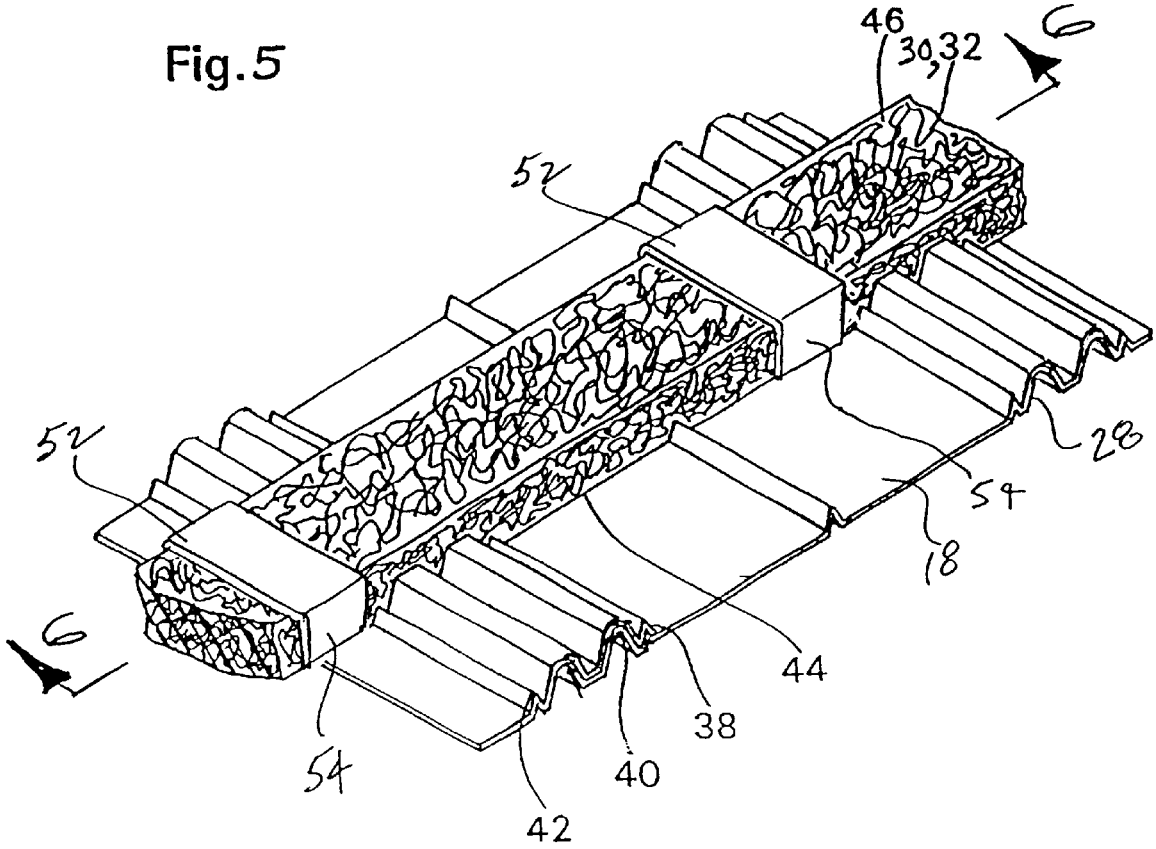
FIG. 5 is an enlarged perspective view of an alternative embodiment of the air-permeable and resilient strip on alternate roof panels with the stand-off clips being utilized at each of fastener location.
Figure 6:
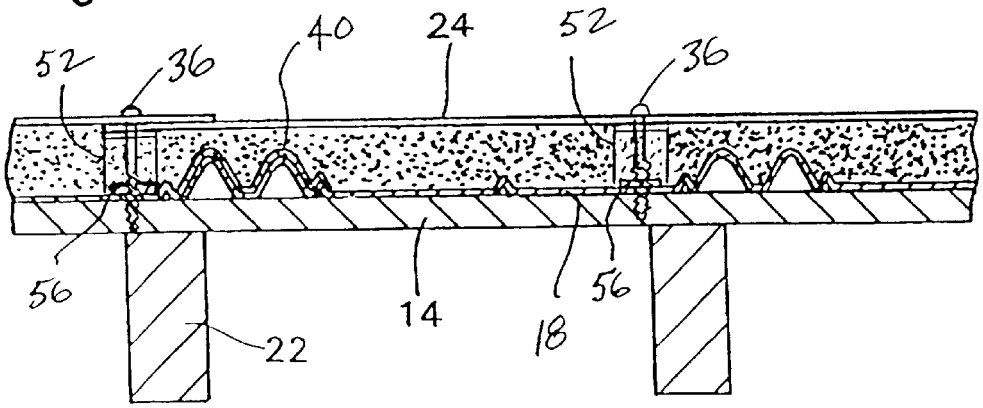
FIG. 6 is a cross sectional view taken along line 6—6 in FIG. 5.

While the stand-off clips 52 are only located in the areas on the contoured roof panels 18 which do not include a large stiffening rib 28 or standing seam 40, as shown in the alternate embodiment of the roofing system in FIGS. 5 and 6, certain types of roof panels 18 include ribs 28 and standing seams 40 which are too small to reliably be penetrated with the fastener 36. In such installations, the stand-off clips 52 are located in the flat area of the roofing panel 18 adjacent to the ribs 20 or standing seams 40 at the desired spacing required for holding the ridge cap 24 in place. Preferably, the sealing material 56 is also provided at these locations in order to prevent moisture in grants at the positions where the screw fastener 36 penetrates the contoured roof panel 18.

The strip 30 completely fills the space between the contoured roof panel 18 and the ridge cap 24, with the ridge cap 24 engaging the planer upper surfaces 46 of the strip 30. The lower surface 44 of the strip 30 matches the contour of the roof panels 18. Those skilled in the art will recognize from the present disclosure that different contours in the strip 30 will be required and that the thickness of the strip 30 may vary, depending upon the height of the ribs 20 and standing seams 40.

In order to install the ridge vent in accordance with the present invention, after the contoured roof panels 18 have been installed on the decking 14, the strips 30 are placed along each side of the open slot 26 running along the ridge. The stand off clips 52 are placed at the desired spacing over the strip 30 at the fastener locations for the ridge cap 24 which do not fall on standing seams 40 or stiffening ribs 28 which can receive a fastener 36 for holding the ridge cap 24 in position. Preferably, the sealing material 56 is placed on the surface of the contoured roof panel 18 under each stand-off clip 52. The ridge cap pieces 34 are then placed in position over the stand-off clips 52 and the strips 30. The fasteners 36 are then driven through the ridge cap 24, the stand off clips 52, the strip 30, the contoured roof panels 18 and into the decking 14 at the desired locations along the ridge cap 24 to hold the ridge cap 24 in position. The fasteners 36 may also be driven through the ridge cap 24, the strip 30 and standing seams 40 or ribs 28 of sufficient size.

While the preferred embodiments of the invention have been described in detail, the invention is not limited to the specific embodiments described above, which should be considered as merely exemplary. For example, the stand-off clips 52 can be used in conjunction with other types of roofs, such as composition rules, as well as with other types of air-permeable strips 30 in order to prevent over-driving of the fasteners through the ridge vent. Further modifications and extensions of the present invention may be developed, and all such modifications are deemed to be within the scope of the present invention as defined by the appended claims.

What is claimed is:

1. A contoured roof ventilation system comprising:

a strip having an air permeable section located adjacent to a ridge slot of a roof structure;

a stand-off clip located over the strip;

a ridge cap located over the ridge slot and at least a portion of the strip; and at least one fastener driven through the cap, clip and strip into the roof structure such that the clip limits local deformation of the strip at the fastener.

2. The contoured roof ventilation system of claim 1, wherein the strip is formed to fit an exterior roof surface profile.

3. The contoured roof ventilation system of claim 1, wherein the strip has a depression in a contact area of each of the stand-off clips.

4. The contoured roof ventilation system of claim 1, wherein the stand-off clip is generally U-shaped.

5. The contoured roof ventilation system of claim 1, wherein the fasteners are threaded.

6. The contoured roof ventilation system of claim 1, wherein the roof structure comprises roof panels having raised sections, and the fasteners are located at the roof panel raised sections.

7. The contoured roof ventilation system of claim 1, wherein the roof structure comprises roof panels having raised sections, and the clips are located between roof panel raised sections.

* * * * *